United States Patent [19]

Benno

[11] Patent Number: 4,747,486

[45] Date of Patent: May 31, 1988

[54] MULTIPACKAGE OF CONTAINERS IN A TRAY

[76] Inventor: Edward L. Benno, 17960 W. Hwy. 120, Grayslake, Ill. 60030

[21] Appl. No.: 30,064

[22] Filed: Mar. 25, 1987

[51] Int. Cl.[4] ..... B65D 71/00

[52] U.S. Cl. ..... 206/427; 53/399; 53/441; 206/45.33; 229/52 BC; 229/52 B

[58] Field of Search ..... 53/399, 48, 441, 442, 53/558; 206/45.33, 427, 432, 497, 431; 229/164, 52 B, 52 BC

[56] References Cited

U.S. PATENT DOCUMENTS

| | | | |
|---|---|---|---|
| 3,014,635 | 12/1961 | Mairs et al. | 229/164 |
| 3,425,544 | 2/1969 | Ayer et al. | 206/45.33 |
| 3,656,614 | 4/1972 | Jacobson | 206/432 |
| 3,826,357 | 7/1974 | Roth | 206/497 |
| 3,883,000 | 5/1975 | Gibbs | 206/432 |

FOREIGN PATENT DOCUMENTS

| | | | |
|---|---|---|---|
| 2208985 | 8/1973 | Fed. Rep. of Germany | 206/497 |
| 1211586 | 11/1970 | United Kingdom | 206/432 |

*Primary Examiner*—Jimmy G. Foster
*Attorney, Agent, or Firm*—Edward L. Benno

[57] ABSTRACT

A package of a rectangular tray with a rectangular array of generally cylindrical containers carried therein in a conforming pattern with a stretched-tensioned-elastic plastics material tube encircling the bottom and side walls of the tray and the upper portions of the container array. The side walls of the tray are relatively low, and the end walls are relatively high and provided with hand holds. The tensioned tube causes the bottom wall of the tray to be curvilinear about an axis longitudinally and centrally of said package so that the package will not bend downwardly about a transverse central axis of the package when the package is carried by a person grasping the hand holds in the end walls of the tray.

5 Claims, 1 Drawing Sheet

Fig. 1
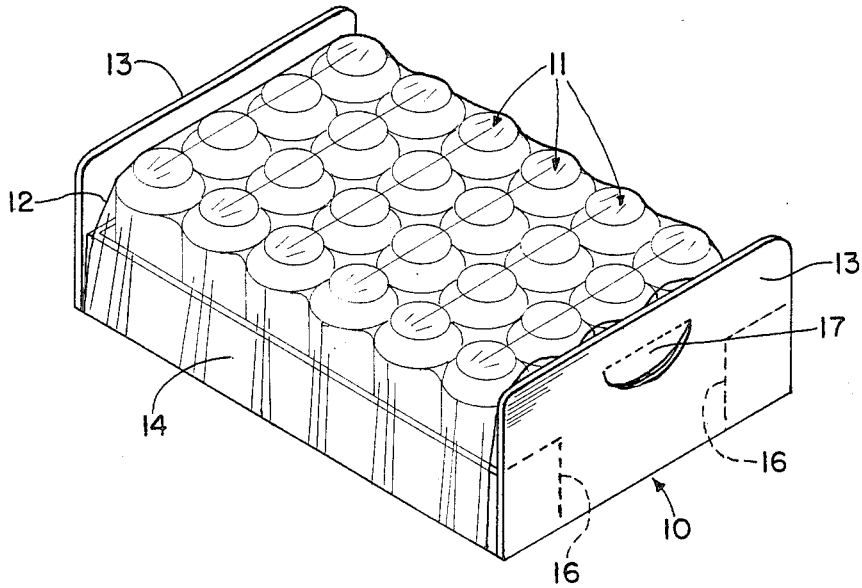
Fig. 2
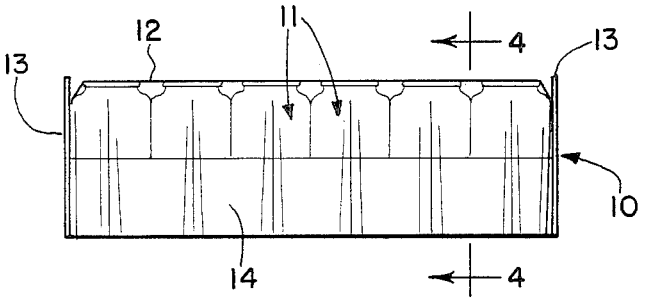
Fig. 3
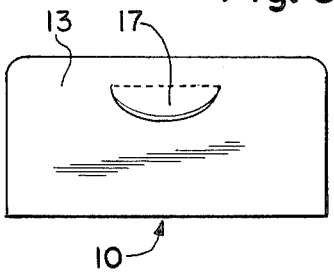
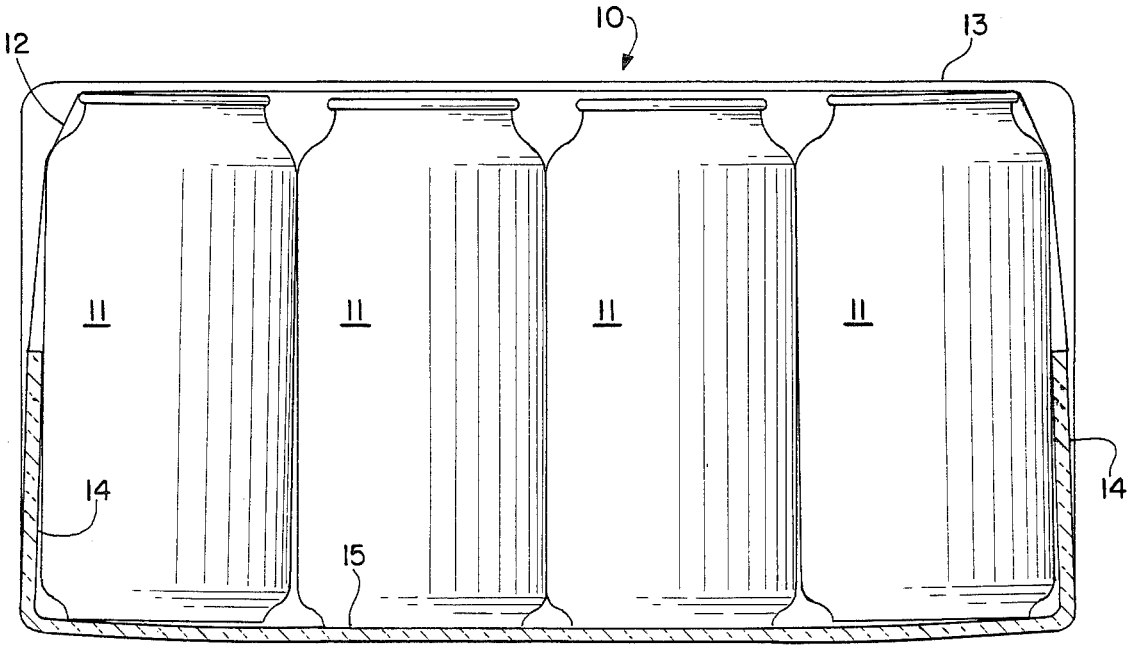
Fig. 4

MULTIPACKAGE OF CONTAINERS IN A TRAY

BACKGROUND OF THE INVENTION

A common package for shipping, handling and selling a group of articles such as 12 oz. beverage cans is a shallow corrugated pasteboard tray. The pasteboard material of such trays is about 1/16 of an inch in thickness. Generally the trays have sidewalls which are no higher than the middle of the cans and for a standard 12 oz. beverage can that sidewall height would be about 2 and ½ inches. For a tray of 24 cans the tray is rectangular and about 16 inches long and 10 and ½ inches wide. A tray of 24 (12 oz.) beverage cans weighs a rather substantial 22 pounds. If the cans are placed in the tray without any binding between the cans which might tie the cans together in some way, the tray is difficult to carry by a person. That is of course, because of the weight of the cans, the minimum of support provided by the thin pasteboard, and the single layer side-by-side rectangular array of the 24 cans. If a person carrys the tray with his hands at the opposite end bottom wall portions, the tray tends to bend or fold downward about a transverse central axis. The relatively low sidewalls then tend to crease outwardly at the longitudinal centers thereof, and the cylindrical cans slide over one another at their upper ends and move sidewise out of the rectangular array with the cans along sidewalls tending to fall from the tray. A better way for the person to cradle or carry such a tray is to hold it at the opposite side central bottom wall portions. There is then a tendency for the tray to bend or fold downward about a longitudinal central axis. Because the transverse dimension of the tray is substantially less than the longitudinal dimension the tray may not bend enough to lose cans from the ends of the tray.

There are a number of prior art solutions to the described problem of carrying such trays. Probably the most common solution is to wrap the tray with a shrink film. Another solution is to make the tray of a material that has a stiffness sufficient to support the array without bending as the tray is carried. Another solution is to raise the height of the side and end walls of the tray to the top, or almost to the top, of the cans to give the side and end walls further rigidity against bending or creasing out of their vertical planes and to hold loose cans within the tray.

SUMMARY OF THE INVENTION

The subject invention is yet another solution to the above described problem of carrying such trays. It is the primary object of the invention to provide a unique package that keeps the thickness of the pasteboard to a minimum, uses very little more, if any, additional pasteboard material, and avoids the complicated equipment and ovens necessary with shrink film.

Other objects and features of the invention are that major areas of the can side walls be exposed for clear store shelf product presentation in the package, that the best arrangement for carrying the package be apparent to a person upon viewing the package, and that the package be simple and secure for shipping, handling, and carrying by a person.

The package of the subject invention comprises a thin-walled pasteboard tray which is rectangular with the longitudinal sidewalls of a height no greater than about one half the height of the cans and the transverse end walls of a height greater than one half the height of the cans. The cylindrical cans of the package are arranged in a rectangular array filling the tray. A further feature of the invention is that bottles can be used in the package in place of cans. The package further comprises a substantially stretched tube of resilient, elastic plastics material under substantial tension encircling the tray and can array therein about an axis extending longitudinally of the tray. The stretching and application of the tube can be accomplished by using the method of my U.S. Pat. No. 4,454,705. In the stretched, tensioned and applied condition of the tube, its ends above the side walls of the tray lie over the end ranks of cans and inwardly of the end walls of the tray. The upper central portions of the end walls are provided with handles such as hand holds cut through the pasteboard on a curve that is concave upwardly.

In reductions to practice of the above described package it has been discovered that there is an unexpected rigidity in the package along its longitudinal axis when the tray is carried by a person grasping the hand holds in the opposite end walls of the package, even when the side walls are of a substantially insignificant height. In a study of the reductions to practice it appears that the bottom wall of the tray is slightly curvilinear about an axis longitudinally of the tray. That curve is shown in the enlarged cross section in FIG. 4 of the drawing, and that upwardly concave curvature of the bottom wall is believed to be a significant factor in producing the noted unexpected rigidity.

Other objects and features of the invention will be apparent upon a perusal of the hereinafter detailed description read in conjunction with the drawing.

DESCRIPTION OF THE DRAWING

FIG. 1 is an isometric view of one embodiment of the invention;

FIG. 2 is a side elevational view of the package of FIG. 1;

FIG. 3 is an end elevational view of the package of FIG. 1; and

FIG. 4 is an enlarged cross sectional view of the package of FIG. 1 taken along the line 4—4 of FIG. 2.

DETAILED DESCRIPTION OF THE INVENTION

As shown in the drawing, one preferred embodiment of the invention comprises a tray 10, a plurality of cans 11, and a stretched, tensioned, elastic plastics tube 12.

In the preferred embodiment the tray 10 is made of a relatively thin corrugated pasteboard. Relatively thin here means pasteboard thicknesses of about 1/16 of an inch. The tray 10 can be cut or punched from flat sheet stock of pasteboard. The tray 10 comprises opposite end walls 13, opposite side walls 14, and a bottom wall 15. In cutting the tray from the stock, extensions 16 of the side walls 14 are provided, and the tray 10 in the shape shown is made by folding the side walls 14 upright, folding and placing an adhesive on the extensions 16, and folding and securing the end walls 13 upright against the extensions 16.

In a preferred embodiment for 24 (12 oz.) beverage cans 11, the tray 10 is made with the side walls 14 about 16 inches long and the end walls 13 about 10 and ½ inches long. In the embodiment shown in the drawing the side walls 14 have a height of about ½ the height of the cans 11, or about 2 ½ inches. The side walls 14 can be made substantially lower in height, for example about ½ inch. If the side walls are almost absent, gussets can be provided between the bottom wall 15 and the extensions 16. Some height to the side walls 14 is preferred because in many beverage businesses the cans 11 after being filled and sealed are deposited upon an unfolded tray blank and the side and end walls of the tray are folded and secured about the can array. As the tray and cans further proceed in a production line, some side walls are preferred to keep the cans in the moving tray. Obviously, the lower the side walls 14, the lower the tray cost.

The end walls 13 have a height greater than one half the height of the cans. In a preferred embodiment the end walls 13 have a height about that of the cans 11, or about 5 inches. Conveniently, in the cutting of the tray blank a hand hold 17 can be cut in each end wall 13. Each hand hold 17 is positioned in the end wall 13 above a horizontal line half way up the sides of the cans 11. The hand hold 17 may have shapes other than the upwardly concave shape shown in the drawing, but should have a shape that provides for comfortable insertion of a person's fingers therethrough in a grasping of the wall 13.

In a preferred embodiment of the cans or containers 11, they are 12 oz. necked-in beverage cans. They can be straight sidewalled cylindrical cans, or in the alternative, cans such as are known in the art as cone topped cans. The containers 11 can also be bottles.

In preferred embodiments, the stretched, tensioned, elastic plastics tube 12 can be made of blown film in materials such as polyethylene, polypropylene, or ethylene-vinyl acetate copolymer resin. In polyethylene, it may be what is known as low density or linear low density in the art. The film of the tube 12 is relatively thin. For example, in a number of reductions to practice an unstretched film thickness of 1 and ½ mils was found satisfactory. The degree of stretch of the tube 12 in the package 10 is that which in the applied condition circumferentially about the tray 10 side walls 14, the sides and tops of the cans 11, and the bottom wall 15 of the tray 10 will slightly curve the bottom wall 15 of the tray 10 about an axis longitudinally centrally of the tray 10. As used here the term slightly means enough of a curvature in the plane of the bottom wall 15 so that there be substantially no downward bending of the package about a transverse axis when the package is carried by a person grasping the hand holds 17 at each end of the package. For example, in some reductions to practice a low density polyethylene material of about 1 and ½ mil thickness was used. As an unstretched tube it was what is known in the art as a 12 inch layflat tube. Such a tube is 24 inches in circumference. In the stretched applied condition the circumference of the tube was about 31 inches, and in that stretched applied condition the tube 12 was elastically tensioned to produce the curvature in the bottom wall 15 substantially as shown in FIG. 4. Also, in those reductions to practice, the tray 10 was about 16 inches long, 10 and ½ inches wide and the cans 11 were about 5 inches high. Further, the side walls 14 were about 2 and ½ inches high and the end walls 13 were about 5 inches high. The packages weighed about 22 pounds and were carried by the hand holds 17. No downward bending of the package about a transverse axis was observed. The packages further appeared capable of absorbing rough handling while maintaining the package integrity shown and described.

It should be understood that the initial tube as made or selected should not be so small in circumference that the elastic limits of the material are exceeded as the tube is stretched and applied about the tray 10 and cans 11. Of course, to minimize the use of material, the unstretched tube should be selected or made in a size producing a stretched condition close to but short of the elastic limits of the material.

In the preferred embodiments the initial length of the tube 12 is such that in the stretched applied condition, the ends of the tube 12 overlay the upper portions of the end ranks of cans 11 and are adjacent the upper inner sides of the end walls 13. For example, in some reductions to practice where the tray 10 was 16 inches long, an initial tube length of about 18 inches was sufficient so that in the stretched applied condition the ends of the tube 12 did overlay the end ranks of cans 11. The initial lengths of the tube 12 will depend upon the material selected and its initial thickness and circumference.

Having described the invention, it is to be understood that changes can be made in the described embodiments by a person skilled in the art within the spirit and scope of the claims.

I claim:

1. A package comprising a tray having a bottom wall with opposed side walls and opposed end walls extending upwardly from the periphery of said bottom wall, said tray being formed to be rectangular in shape, a plurality of containers carried in a rectangular array on said bottom wall with the dimensions of said rectangular array substantially conforming to the dimensions of said bottom wall, said side walls of said tray of a height substantially no higher than one half of the height of said containers, said end walls of said tray of a height substantially greater than one half of the height of said containers, hand holds formed in the upper central portions of each of said end walls of said tray, said tray being formed of a material and said containers being of such a weight that supporting said tray with said containers therein in a depending condition from said hand holds results in a substantial bending of said tray about a transverse central axis, and a stretched-tensioned-elastic -plastics material tube carried circumferentially about said side walls and bottom wall of said tray and the sides and upper end of said rectangular array of containers with the ends of said tube overlying the upper ends of the end ranks of said rectangular array of containers and between the planes of said end walls of said tray, and said tube being sufficiently tensioned to render said bottom wall curvilinear in an upwardly concave shape about an axis extending longitudinally centrally of said tray causing resistance in the tray for bending about said transverse central axis.

2. In a package as defined in claim 1, in which said side walls of said tray are of a height substantially equal to one half of the height of said containers.

3. In a package as defined in claim 1, in which said side walls are substantially lower in height than one half of the height of said containers.

4. In a package as defined in claim 1, in which the length of the side walls of said tray are at least fifty percent longer than the length of the end walls of said tray.

5. In a package as defined in claim 1, in which said containers are generally cylindrical in shape.

* * * * *